US005588542A

United States Patent [19]

Winkler, Jr. et al.

[11] Patent Number: 5,588,542

[45] Date of Patent: Dec. 31, 1996

[54] FISHING ROD RACK

[76] Inventors: Louis J. Winkler, Jr., Rt. 1, Box 110, Hiwassee, Va. 24347; Louis J. Winkler, Sr., 9 Hopkins St., Glen Burnie, Md. 21061

[21] Appl. No.: 419,458

[22] Filed: Apr. 10, 1995

[51] Int. Cl.[6] ..... A47F 5/00

[52] U.S. Cl. ..... 211/70.8; 211/89; 248/513

[58] Field of Search ..... 211/70.8, 89, 68, 211/64, 4; 248/512, 513

[56] References Cited

U.S. PATENT DOCUMENTS

| | | | |
|---|---|---|---|
| D. 268,461 | 4/1983 | Wess et al. . | |
| D. 300,283 | 3/1989 | Duckro, Jr. et al. . | |
| 1,257,107 | 2/1918 | Patterson | 211/64 |
| 1,342,517 | 6/1920 | Tyson | 211/68 X |
| 3,376,614 | 4/1968 | Stahl | 211/70.8 |
| 3,537,595 | 11/1970 | Mathisen . | |
| 3,635,433 | 1/1972 | Anderson | 211/70.8 X |
| 3,701,504 | 10/1972 | Woods et al. . | |
| 4,176,819 | 12/1979 | Lowe | 248/513 |
| 5,152,494 | 10/1992 | Frunzar | 248/513 |
| 5,257,700 | 11/1993 | Wallace . | |
| 5,487,475 | 1/1996 | Knee | 211/70.8 |

*Primary Examiner*—Robert W. Gibson, Jr.

[57] ABSTRACT

A fishing rod rack for supporting a fishing rod relative to a support surface. The inventive device includes a lower engaging assembly mountable to a vertical wall surface for receiving a lower end of a fishing rod. An upper engaging assembly is mountable to the vertical wall surface spaced from the lower engaging assembly for receiving an upper end of the fishing rod so as to support the fishing rod in cooperation with the lower engaging assembly. The upper engaging assembly includes a fixed upper support plate and a pivoting upper support plate which can be opened to facilitate positioning of the upper end of the fishing rod into an aperture directed through support plates.

11 Claims, 4 Drawing Sheets

FISHING ROD RACK

BACKGROUND OF THE INVENTION

1. Field of the Invention

The present invention relates to rack structures and more particularly pertains to a fishing rod rack for supporting a fishing rod relative to a support surface.

2. Description of the Prior Art

The use of rack structures is known in the prior art. More specifically, rack structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art rack structures include U.S. Pat. Nos. 5,257,700; 3,537,595; 3,701,504; U.S. Design Patent 300, 283; and U.S. Design Patent 268,461.

While these devices fulfill their respective, particular objectives and requirements, the aforementioned patents do not disclose a fishing rod rack for supporting a fishing rod relative to a support surface which includes a lower engaging assembly mountable to a vertical wall surface for receiving a lower end of a fishing rod, and an upper engaging assembly mountable to the vertical wall surface spaced from the lower engaging assembly for receiving an upper end of the fishing rod so as to support the fishing rod in cooperation with the lower engaging assembly, wherein the upper engaging assembly includes a fixed upper support plate and a pivoting upper support plate which can be opened to facilitate positioning of the upper end of the fishing rod into an aperture directed through support plates.

In these respects, the fishing rod rack according to the present invention substantially departs from the conventional concepts and designs of the prior art, and in so doing provides an apparatus primarily developed for the purpose of supporting a fishing rod relative to a support surface.

SUMMARY OF THE INVENTION

In view of the foregoing disadvantages inherent in the known types of rack structures now present in the prior art, the present invention provides a new fishing rod rack construction wherein the same can be utilized for supporting a fishing rod relative to a vertical support surface. As such, the general purpose of the present invention, which will be described subsequently in greater detail, is to provide a new fishing rod rack apparatus and method which has many of the advantages of the rack structures mentioned heretofore and many novel features that result in a fishing rod rack which is not anticipated, rendered obvious, suggested, or even implied by any of the prior art rack structures, either alone or in any combination thereof.

To attain this, the present invention generally comprises a fishing rod rack for supporting a fishing rod relative to a support surface. The inventive device includes a lower engaging assembly mountable to a vertical wall surface for receiving a lower end of a fishing rod. An upper engaging assembly is mountable to the vertical wall surface spaced from the lower engaging assembly for receiving an upper end of the fishing rod so as to support the fishing rod in cooperation with the lower engaging assembly. The upper engaging assembly includes a fixed upper support plate and a pivoting upper support plate which can be opened to facilitate positioning of the upper end of the fishing rod into an aperture directed through support plates.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fishing rod rack apparatus and method which has many of the advantages of the rack structures mentioned heretofore and many novel features that result in a fishing rod rack which is not anticipated, rendered obvious, suggested, or even implied by any of the prior art rack structures, either alone or in any combination thereof.

It is another object of the present invention to provide a new fishing rod rack which may be easily and efficiently manufactured and marketed.

It is a further object of the present invention to provide a new fishing rod rack which is of a durable and reliable construction.

An even further object of the present invention is to provide a new fishing rod rack which is susceptible of a low cost of manufacture with regard to both materials and labor, and which accordingly is then susceptible of low prices of sale to the consuming public, thereby making such fishing rod racks economically available to the buying public.

Still yet another object of the present invention is to provide a new fishing rod rack which provides in the apparatuses and methods of the prior art some of the advantages thereof, while simultaneously overcoming some of the disadvantages normally associated therewith.

Still another object of the present invention is to provide a new fishing rod rack for supporting a fishing rod relative to a support surface.

Yet another object of the present invention is to provide a new fishing rod rack which includes a lower engaging assembly mountable to a vertical wall surface for receiving a lower end of a fishing rod, and an upper engaging assembly mountable to the vertical wall surface spaced from the lower engaging assembly for receiving an upper end of the fishing rod so as to support the fishing rod in cooperation with the lower engaging assembly.

Even still another object of the present invention is to provide a new fishing rod rack wherein the upper engaging assembly includes a fixed upper support plate and a pivoting upper support plate which can be opened to facilitate positioning of the upper end of the fishing rod into an aperture directed through support plates.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
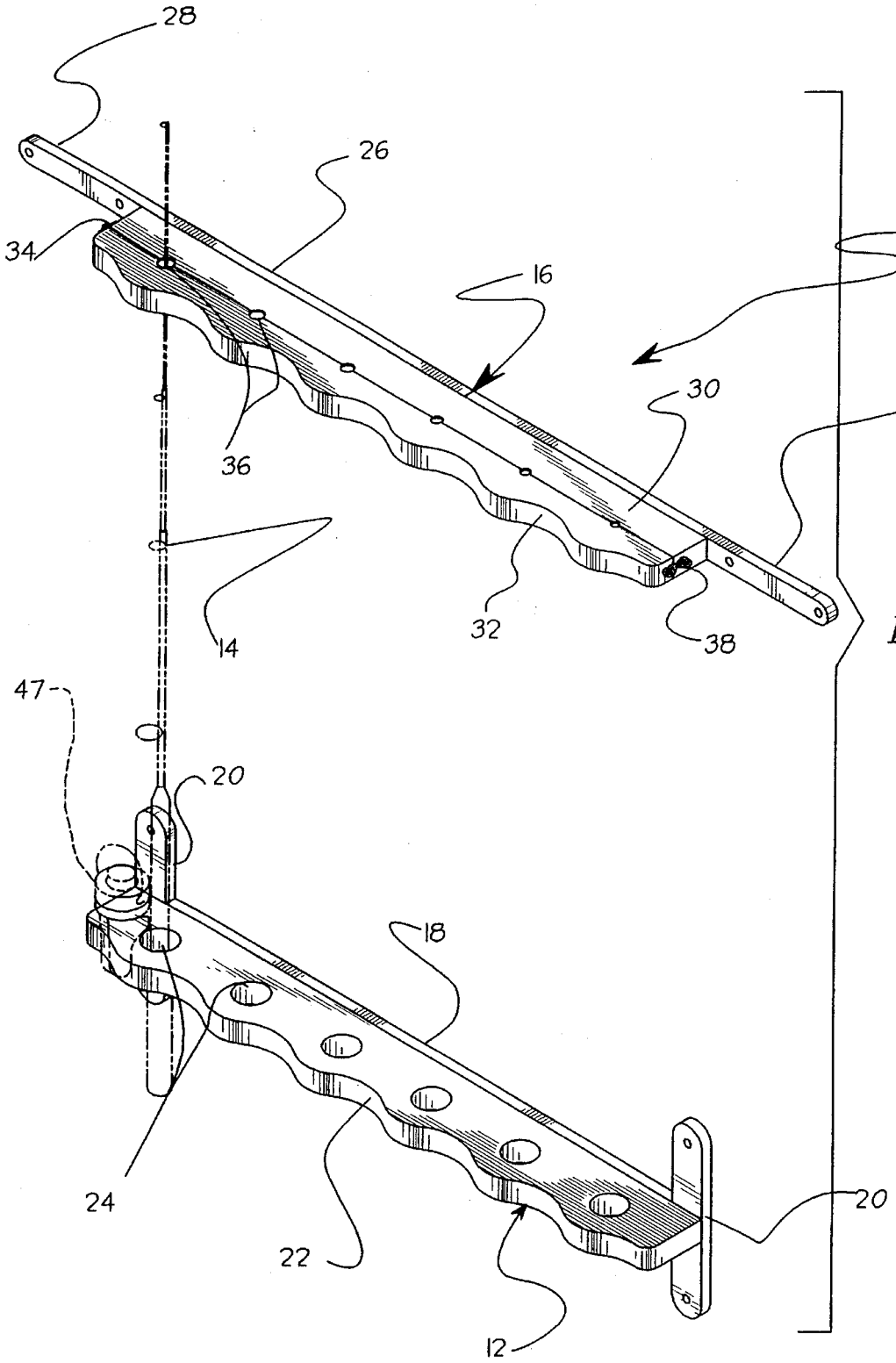
FIG. 1 is an isometric illustration of a fishing rod rack according to the present invention, in use.

With reference now to the drawings, and in particular to FIGS. 1–6 thereof, a new fishing rod rack embodying the principles and concepts of the present invention and generally designated by the reference numeral 10 will be described.

More specifically, it will be noted that the fishing rod rack 10 comprises a lower engaging means 12 which can be mounted to a vertical support surface and operates for receiving and supporting a lower end of a fishing rod 14, as shown in FIG. 1 of the drawings. An upper mounting means 16 is similarly securable to the wall surface and operates for receiving and supporting an upper end of the fishing rod 14. By this structure, one or more fishing rods 14 can be supported relative to the wall surface.

With continuing reference to FIG. 1, it can be shown that the lower engaging means 12 comprises a lower mounting plate 18 having lower lateral portions 20 extending therefrom. The lower lateral portions 20 are shaped so as to define mounting apertures directed therethrough which permit the direction of threaded fasteners through the mounting plate and into the wall surface to secure the lower engaging means 12 thereto. A lower support plate 22 extends from the lower mounting plate 18 and includes opposed upper and lower surfaces. The lower support plate 22 is shaped so as to define a plurality of spaced lower receiving apertures 24 directed therethrough from the upper surface to the lower surface thereof which permit the passage of the handle or lower portion of the fishing rod 14, as shown in FIG. 1. If desired, the lower receiving apertures 24 may alternatively extend only partially into the lower support plate 22 from the upper surface thereof.

Figure 2:
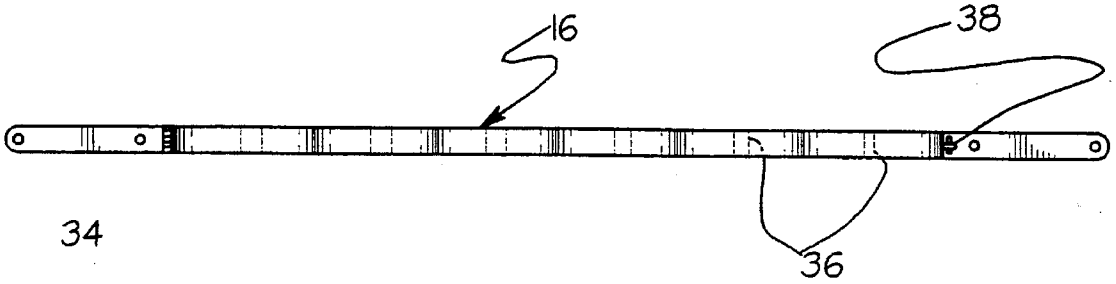
FIG. 2 is a front elevational view of an upper engaging means of the present invention.
Figure 3:
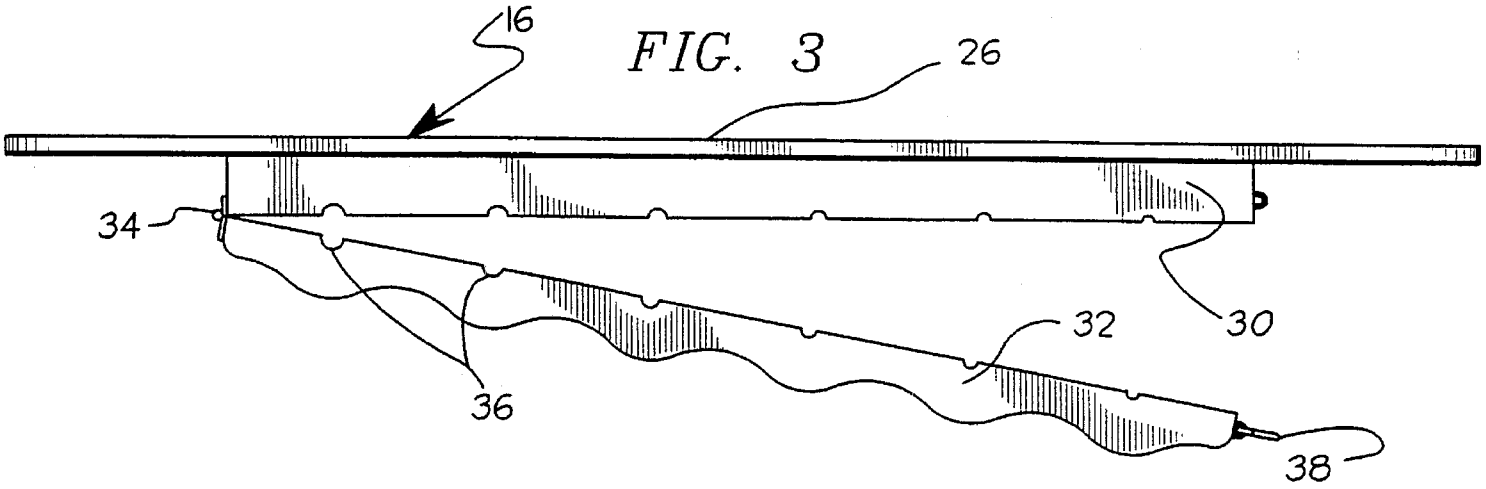
FIG. 3 is a top plan view of the upper engaging means.

Referring now to FIGS. 2 and 3, it can be shown that the upper engaging means 16 comprises an upper mounting plate 26 having upper lateral portions 28 extending therefrom. The upper lateral portions 28 are shaped so as to define mounting apertures directed therethrough permitting the passage of threaded fasteners or the like through the upper lateral portions 28 and into the associated wall. A fixed upper support plate 30 is mounted to the upper mounting plate 26 and includes an upper surface spaced from a lower surface and a longitudinal outer edge. The fixed upper support plate 30 is shaped so as to define a plurality of semi-cylindrical bores directed into the outer edge and extending from the upper surface thereof to the lower surface. A pivoting upper support plate 32 is pivotally mounted to an end of the fixed upper support plate 30 by a hinge 34 coupled therebetween. The pivoting upper support plate 32 includes an upper surface spaced from a lower surface and a longitudinal inner edge. The pivoting upper support plate 32 is shaped so as to define a plurality of semi-cylindrical bores directed into the inner edge and extending from the upper surface thereof to the lower surface. The semi-cylindrical bores of the support plates 30 and 32 cooperate when the upper engaging means 16 is in the closed position illustrated in FIG. 1 to define a plurality of upper receiving apertures 36 through which the upper end of the fishing rod 14 projects so as to support the upper end relative to the vertical support surface. A latch 38 is secured to the ends of the support plates 30 and 32 opposite of the hinge 34 and can be selectively released to permit opening of the device as shown in FIG. 3. The pivoting upper support plate 32 can thus be opened from the fixed upper support plate 30 to permit insertion of the upper end of the fishing pole 14 into the upper engaging means 16.

Figure 4:
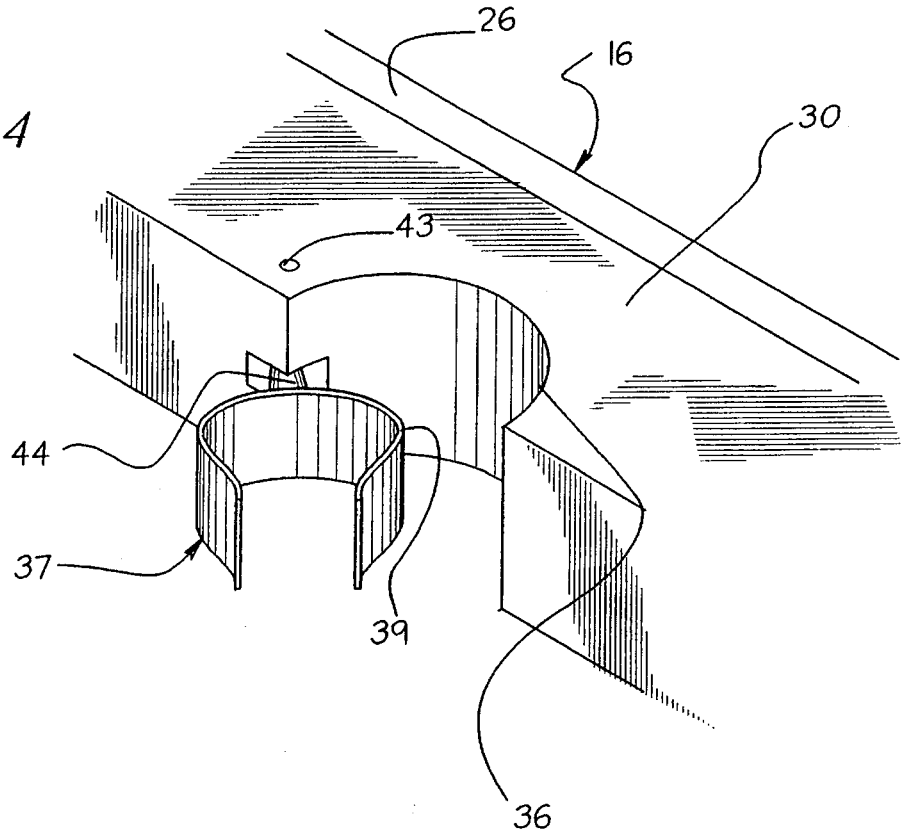
FIG. 4 is an enlarged isometric illustration of a portion of the upper engaging means including a retention clip.

As shown in FIG. 4, the upper engaging means 16 may further comprise a plurality of retention clips 37 which are each mounted within an individual one of the upper receiving apertures 36. The retention clips 37 operate to receive and engage an upper portion of the fishing rod 14 such that when the upper engaging means 16 is opened, the fishing rod or rods will not suddenly fall therefrom. Preferably, the retention clips 37 each comprise a substantially U-shaped clip member 39 within which the upper portion of the associated fishing rod 14 can be positioned. A clip arm 41 projects from the U-shaped clip member 39 and is received within an arm mounting aperture directed into the fixed upper support plate 30 and extending into contiguous communication with a portion of the respective upper receiving aperture 36 thereof. A pivot pin 43 is directed through an interior end of the clip arm 41 and into the fixed upper support plate 30 to pivotally mount the retention clip 37 within the respective upper receiving aperture 36. If desired, a partial transverse dimension of the upper engaging means 16 extending from one of the upper receiving apertures 36 to the upper mounting plate can be sized so as to be substantially larger than a partial transverse dimension of the lower engaging means 12 extending from one of the lower receiving apertures 24 to the lower mounting plate 18 such that a fishing rod and the associated retention clip 37 will automatically pivot from the fixed upper support plate 30 upon opening of the pivoting upper support plate 32.

Figure 5:
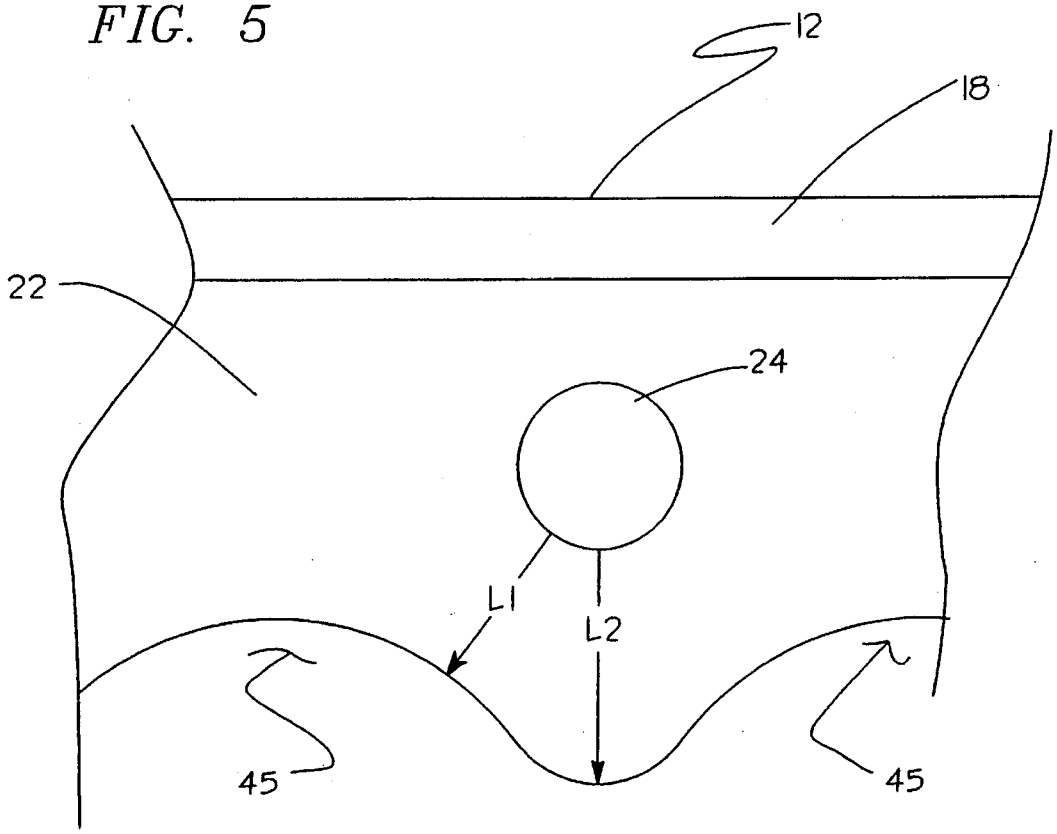
FIG. 5 is an enlarged top plan view of a portion of the lower engaging means.

Referring now to FIG. 5, it can be shown that the lower mounting plate 18 of the lower engaging means 12 may be shaped so as to define a plurality of reel receiving apertures 45 directed into an outer edge thereof and oriented medially between the lower receiving apertures 24. The reel receiving apertures 45 extend into the lower mounting plate 18 such that a minimum distance "L1" between an inner edge of each of the reel receiving apertures 45 and an adjacent lower receiving aperture 24 is substantially less than a maximum distance "L2" between the same lower receiving aperture 24 and the outer edge of the lower support plate 22. By this configuration of the lower support plate 22, a reel 47 of an associated fishing pole 14 can be positioned within one of the reel receiving apertures 45 so as to secure the fishing rod 14 against rotation relative to the lower support plate 22 of the lower engaging means 12. The outer edge of the pivoting upper support plate 32 can be similarly shaped so as to match the appearance of the lower engaging means 12 and further an ornamental appearance of the overall device 10.

Figure 6:
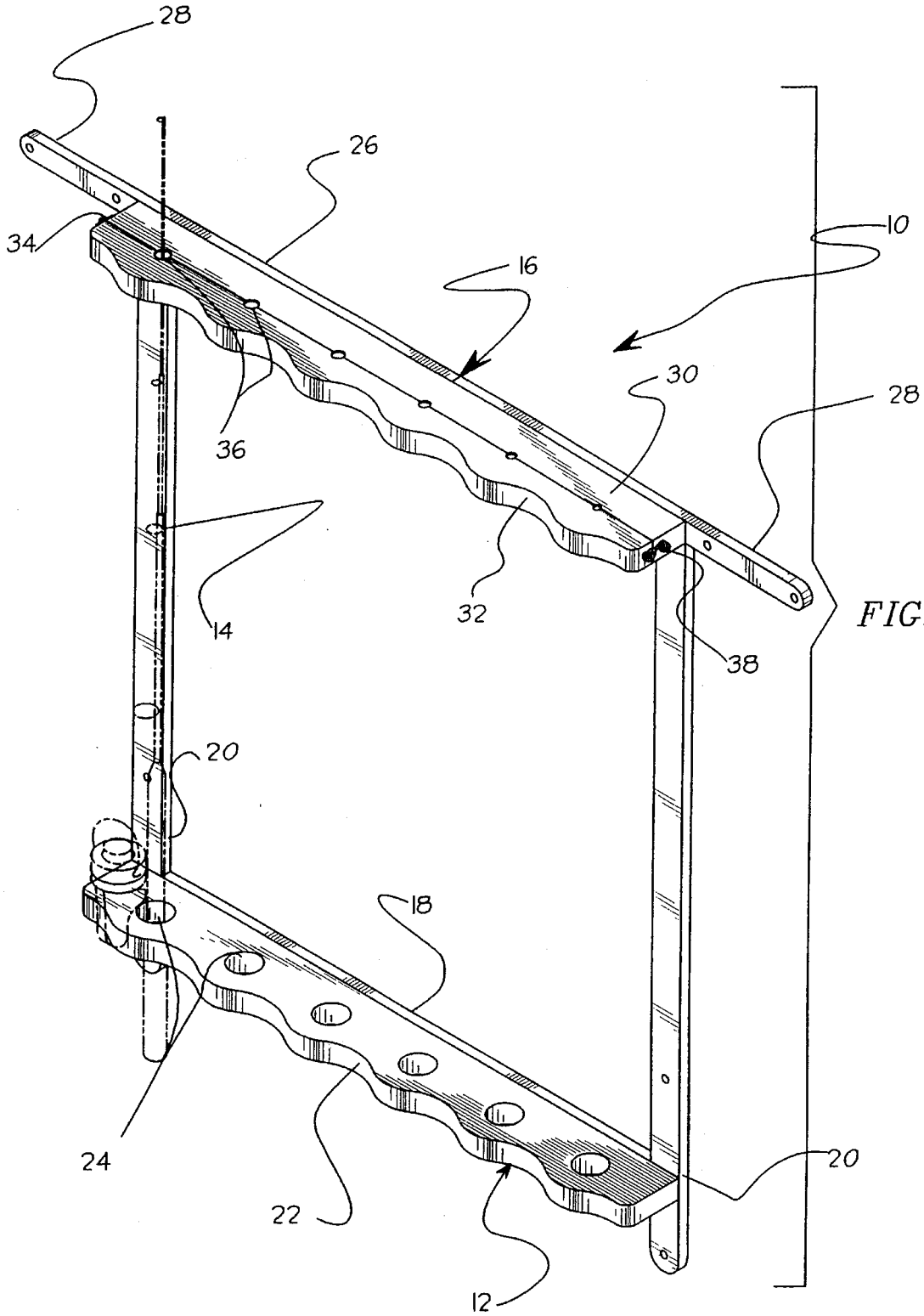
FIG. 6 is an isometric illustration of the fishing rod rack wherein the upper engaging means is coupled to a lower engaging means of the invention.

As shown in FIG. 6, the lower lateral portions 20 of the lower mounting plate 18 may be elongated in configuration and extend from the lower mounting plate to couple with the upper mounting plate 26 of the upper engaging means 16. The lower lateral porions 20 can be secured to the upper mounting plate 26 via fasteners or through a use of conventionally know adhesives. However, it is preferable that the mounting plates 18 and 26 be separately configured as shown in FIGS. 1 through 3 such that the end user is permitted to install the device 10 with the upper engaging means 16 at any desired spacing and alignment relative to the lower engaging means 12.

In use, the fishing rod rack 10 according to the present invention can be easily utilized to effect supporting of a plurality of fishing rods 14 in a spaced and parallel orientation relative to a wall surface. The device 10 thus provides for organized and readily available storage of fishing equipment such as the fishing rod 14 illustrated herein.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A fishing rod rack comprising:

a lower engaging means which can be mounted to a vertical support surface for receiving and supporting a lower end of a fishing rod;

an upper mounting means securable to a wall surface for receiving and supporting an upper end of the fishing rod, wherein the upper engaging means comprises an upper mounting plate; a fixed upper support plate mounted to the upper mounting plate and including an upper surface spaced from a lower surface and a longitudinal outer edge, the fixed upper support plate being shaped so as to define a plurality of semi-cylindrical bores directed into the outer edge and extending from the upper surface thereof to the lower surface; a pivoting upper support plate pivotally mounted to an end of the fixed upper support plate, the pivoting upper support plate including an upper surface spaced from a lower surface and a longitudinal inner edge, the pivoting upper support plate being shaped so as to define a plurality of semi-cylindrical bores directed into the inner edge and extending from the upper surface thereof to the lower surface, wherein the semi-cylindrical bores of the support plates cooperate to define a plurality of upper receiving apertures through which an upper portion of the fishing rod can project;

wherein the upper engaging means further comprises a latch secured to ends of the support plates;

wherein the upper mounting plate of the upper engaging means includes upper lateral portions extending therefrom, the upper lateral portions being shaped so as to define mounting apertures directed therethrough, wherein the lower engaging means comprises a lower mounting plate; a lower support plate extending from the lower mounting plate, the lower support plate being shaped so as to define a plurality of spaced lower receiving apertures which receive a lower portion of a fishing rod; and wherein the lower mounting plate includes opposed upper and lower surfaces, the lower receiving apertures being directed through the lower support plate from the upper surface to the lower surface thereof.

2. The fishing rod rack of claim 1, wherein the lower engaging means comprises a lower mounting plate; a lower support plate extending from the lower mounting plate, the lower support plate being shaped so as to define a plurality of spaced lower receiving apertures which receive a lower portion of a fishing rod.

3. The fishing rod rack of claim 2, wherein the lower mounting plate includes opposed upper and lower surfaces, the lower receiving apertures being directed through the lower support plate from the upper surface to the lower surface thereof.

4. The fishing rod rack of claim 3, wherein the lower mounting plate includes lower lateral portions extending therefrom, the lower lateral portions being shaped so as to define mounting apertures directed therethrough.

5. The fishing rod rack of claim 1, wherein the lower mounting plate includes lower lateral portions extending therefrom, the lower lateral portions being shaped so as to define mounting apertures directed therethrough.

6. The fishing rod rack of claim 5, wherein the lower lateral portions of the lower mounting plate are substantially elongated in configuration and extend from the lower mounting plate, the lower lateral portions being coupled to the upper mounting plate of the upper engaging means.

7. A fishing rod rack comprising:

a lower engaging means which can be mounted to a vertical support surface for receiving and supporting a lower end of a fishing rod;

wherein the upper engaging means comprises an upper mounting plate; a fixed upper support plate mounted to the upper mounting plate and including an upper surface spaced from a lower surface and a longitudinal outer edge, the fixed upper support plate being shaped so as to define a plurality of semi-cylindrical bores directed into the outer edge and extending from the upper surface thereof to the lower surface; a pivoting upper support plate pivotally mounted to an end of the fixed upper support plate, the pivoting upper support plate including an upper surface spaced from a lower surface and a longitudinal inner edge, the pivoting upper support plate being shaped so as to define a plurality of semi-cylindrical bores directed into the inner edge and extending from the upper surface thereof to the lower surface, wherein the semi-cylindrical bores of the support plates cooperate to define a plurality of upper receiving apertures through which an upper portion of the fishing rod can project an upper mounting means securable to a wall surface for receiving and supporting an upper end of the fishing rod; and wherein the upper engaging means further comprises a plurality of retention clips each mounted within an individual one of the upper receiving apertures, the retention clips being adapted to receive and engage an upper portion of a fishing rod.

8. The fishing rod rack of claim 7, wherein the fixed upper support plate is shaped so as to define arm mounting apertures directed into the fixed upper support plate and each extending into contiguous communication with a portion of an individual one of the respective semi-cylindrical bores directed into the outer edge of the fixed upper support plate; and further wherein the retention clips each comprise a substantially U-shaped clip member; a clip arm projecting from the U-shaped clip member and being received within an individual one of an arm mounting apertures; a pivot pin directed through an interior end of the clip arm and into the fixed upper support plate to pivotally mount the retention clip within the respective upper receiving aperture.

9. The fishing rod rack of claim 8, wherein a partial transverse dimension of the upper engaging means extending from an individual one of the upper receiving apertures to the upper mounting plate is substantially larger than a partial transverse dimension of the lower engaging means extending from one of the lower receiving apertures to the lower mounting plate.

10. A fishing rod rack comprising:

a lower engaging means which can be mounted to a vertical support surface for receiving and supporting a lower end of a fishing rod;

an upper mounting means securable to a wall surface for receiving and supporting an upper end of the fishing rod;

wherein the lower engaging means comprises a lower mounting plate; a lower support plate extending from the lower mounting plate, the lower support plate being shaped so as to define a plurality of spaced lower receiving apertures which receive a lower portion of a fishing rod; and wherein the lower mounting plate of the lower engaging means is shaped so as to define a plurality of reel receiving apertures directed into an outer edge thereof and oriented medially between the lower receiving apertures.

11. The fishing rod rack of claim 10, wherein the reel receiving apertures extend into the lower mounting plate such that a minimum distance between an inner edge of each of the reel receiving apertures and an adjacent lower receiving aperture is substantially less than a maximum distance between the lower receiving aperture and the outer edge of the lower support plate.

* * * * *